US005700491A

United States Patent [19]

Herwegh et al.

[11] Patent Number: 5,700,491

[45] Date of Patent: Dec. 23, 1997

[54] MELT LINE FOR SPIN BEAM

[75] Inventors: Felix Herwegh, Haltern; Nils Holger Weide; Wolfgang Schumann, both of Wuppertal, all of Germany

[73] Assignee: Barmag AG, Remscheid, Germany

[21] Appl. No.: 562,116

[22] Filed: Nov. 22, 1995

[30] Foreign Application Priority Data

Nov. 23, 1994 [DE] Germany ..... P 44 41 744.6
Mar. 17, 1995 [DE] Germany ..... 195 09 841.2

[51] Int. Cl.[6] ..... D01D 4/06

[52] U.S. Cl. ..... 425/72.2; 425/392; 425/572

[58] Field of Search ..... 425/72.2, 392, 425/572; 138/DIG. 8, DIG. 11, 121, 172; 215/229; 422/133

[56] References Cited

U.S. PATENT DOCUMENTS

| | | | |
|---|---|---|---|
| 3,486,862 | 12/1969 | Unterstenhoefer | 422/133 |
| 3,705,780 | 12/1972 | Kramer et al. | 425/392 |
| 3,790,418 | 2/1974 | Huvey et al. | 138/DIG. 8 |
| 3,814,565 | 6/1974 | Cahoor et al. | 425/392 |
| 3,847,184 | 11/1974 | God | 138/DIG. 8 |
| 3,860,978 | 1/1975 | Wirth | 138/DIG. 8 |
| 3,992,505 | 11/1976 | Tally | 138/DIG. 8 |
| 4,170,440 | 10/1979 | Gusmer et al. | 422/133 |
| 4,199,547 | 4/1980 | Levinsky et al. | 422/133 |
| 4,218,812 | 8/1980 | Jönsson | 138/DIG. 8 |
| 4,410,281 | 10/1983 | Crookes | 138/DIG. 11 |
| 4,842,503 | 6/1989 | Judge | 425/72.2 |
| 5,439,125 | 8/1995 | Bloch | 215/229 |

FOREIGN PATENT DOCUMENTS

| | | |
|---|---|---|
| 2218239 C2 | 12/1972 | Germany . |
| 1391844 | 4/1975 | United Kingdom . |

*Primary Examiner*—Jay H. Woo
*Assistant Examiner*—Minh-Chau T. Pham
*Attorney, Agent, or Firm*—The Bell Seltzer Intellectual Property Group of Alston & Bird LLP

[57] ABSTRACT

A melt line and a spin beam equipped therewith are disclosed, wherein the melt line (3) serves to advance a molten plastic between a delivery member and an outlet member such as a spinneret. The melt line includes a first line segment (15) and a lower second line segment (17), both of which are downwardly inclined. Also, the first line segment (15) and the second line segment (17) are interconnected by an elbow (16), the elbow (16) having likewise a downward inclination over its entire length and following substantially the form of a helix.

12 Claims, 2 Drawing Sheets

MELT LINE FOR SPIN BEAM

BACKGROUND OF THE INVENTION

The present invention relates to a melt line, a spin beam equipped therewith for spinning a plurality of synthetic filament yarns, and a method of making the melt line.

German Patent 22 18 239 and corresponding U.K. Patent 1,391,844 disclose a spin beam which is constructed as a hollow body, and which is heated from the inside, for example, by a liquid medium. In the hollow body, melt lines are provided for transporting the molten plastic melt, under high melt pressures, to the spin heads which are arranged in a row. Each melt line consists of straight legs and elbows, with each elbow being arranged between two straight legs. To make sure that the melt discharges completely upon shutting down the pump, it is necessary to construct the lines between the melt inlet end and the spin head with a gradient or angle of inclination from the horizontal.

Heretofore, it has been common practice to construct a line of this type such that the line was bent in one plane, and with the ends of the line being subsequently drawn out of the plane of the bend. This configuration of the lines resulted in that the region of the elbow had a different gradient than the remaining line sections. In particular, at one point, the gradient was zero.

It is accordingly an object of the present invention to further develop the known melt line and spin beams equipped therewith, so that the melt line has a unidirected gradient along its entire length, so as to permit the melt to flow out as much as possible without leaving any residue. It is also an object to accomplish this function with as compact a construction of the spin beam as is practicable, and which is easy to fabricate.

SUMMARY OF THE INVENTION

The above and other objects and advantages of the present invention are achieved by the provision of a melt line for advancing a molten plastic in a spin beam which includes a delivery member and an outlet member positioned below the delivery member. The melt line comprises an upper line segment which is downwardly inclined, a lower line segment which is downwardly inclined, and an elbow interconnecting the upper and lower line segments, such that the upper and lower line segments extend in different directions. Also, the elbow is downwardly inclined along its entire length. In a preferred embodiment, the elbow is substantially helical, and the upper line segment, the lower line segment, and the elbow all have the same gradient or angle of inclination.

The melt line of the present invention may thus be characterized in that it comprises at least two line segments inclined relative to one plane, and that the elbow is formed between the line segments and has a gradient over its entire length, and describes in particular a helix. As result of this configuration of the line, the overall height of the spin beam is minimized, since the curvature is no longer formed in one plane.

To curve a tube, the tube is normally bent in one plane. If both legs the thus bent tube are to have a unidirected gradient, the tube will inevitably have no gradient in the region of the bend. Should the pump or other delivery means fail or be shut down, the melt will be unable to flow out under its gravity, and it will tend to accumulate and solidify in the region of the bend. As result of the spatial configuration of the curvature as proposed in accordance with the invention, a unidirected gradient remains between the two legs of the tube.

According to a further concept, it is proposed that all lines of the spin beam be constructed with the same gradient and/or same curvature, thereby reducing the cost of manufacture.

To avoid differences in quality of the spun synthetic filament yarns, it is normally provided that in a spin beam the total length of each line be identical. This ensures that the dwelling time of the melt is the same in each line.

Advantageously, the line segments merge, without transition, tangentially into the helical elbow, the gradient of which remains constant for all desired looping angles, so that no additional space for installation is required. As a result of the tangential transition of the line segments into the helical curvature of the elbow, a uniform gradient of the line segments and the curvature of the line is achieved.

Preferably, each line has a starting section and an end section, which are disposed along parallel axes. These starting and end sections serve to install the line between a delivery member (for example, an extruder or pump), or the melt distribution units and the discharge nozzles or spinnerets. The type of spinnerets and the kind of fabricated products are of no special importance for the present invention.

To fabricate a curved melt line in accordance with the present invention, the melt line may be bent about the surface of a cylinder, so as to obtain the curvature, the cylinder corresponding to the desired radius. In so doing, the line is caused to extend at the same time in axial direction along a helix.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figure 1:
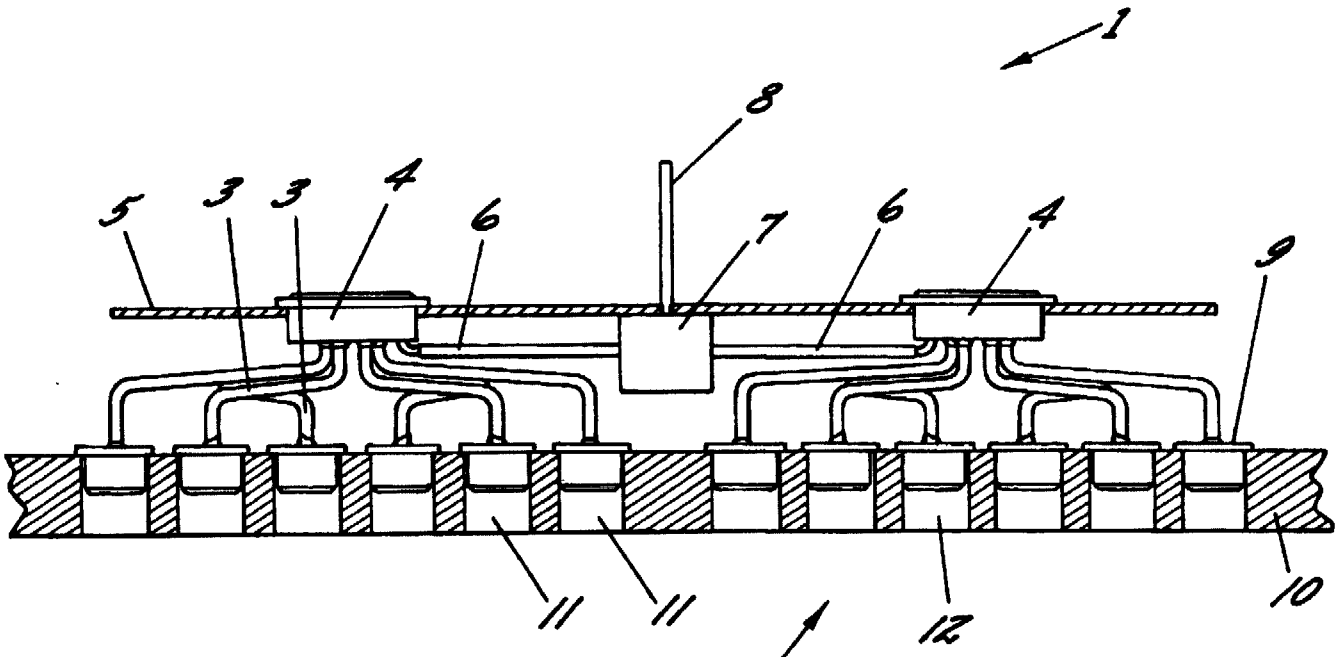
FIG. 1 is a schematic front view of a spin beam which embodies the present invention.

Shown in FIG. 1 is a schematic view of the layout of a spin beam. The spin beam includes a melt distribution unit 1, which is connected via lines 3 to a spinneret unit 2. In this arrangement, it is especially advantageous, when the length of all melt lines 3 is identical, since this allows the same production conditions for all spinnerets to be achieved. However, the accommodation of the lines will require specific configurations, when the lines are to be laid with a gradient.

Figure 2:
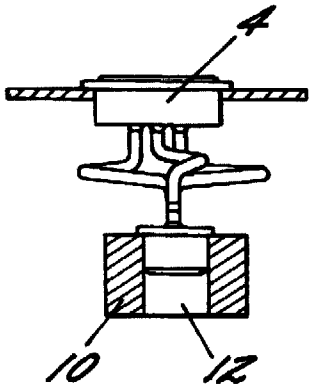
FIG. 2 is a side view of the spin beam of FIG. 1 from the left.

The melt distribution unit 1 comprises several pump connection plates 4, which are arranged on a plate-shaped support 5. In FIGS. 1 and 2, the pumps which are mounted on the connection plates 4, are not shown. The pump connection plates 4 each include a plurality of holes (not shown) extending therethrough, with the plates being connected to lines 3 so that the lines 3 communicate with respective ones of the holes. A melt supply line 6, which is connected via a melt distributor 7 to a main melt line 8, terminates likewise in a hole in the pump connection plate 4.

The lines 3 are joined to connection plates 9, which are again mounted on a support 10. Each connection plate 9 is followed by a spin head 11. Each of the spin heads 11 is arranged in a recess 12 which is formed in a support member Not shown in FIGS. 1 and 2 is the construction of the spin beam walls, which accommodate between them the melt distribution unit and the spinneret unit. Inside the Spin beam, the lines 3 are heated by a heating medium. A spin beam which includes the described structure is further illustrated and described in copending application Ser. No. 08/558,966, filed Nov. 13, 1995, and entitled "Spin Beam for Spinning a Plurality of Synthetic Yarns and Its Manufacture", the disclosure of which is expressly incorporated herein by reference.

Figure 3:
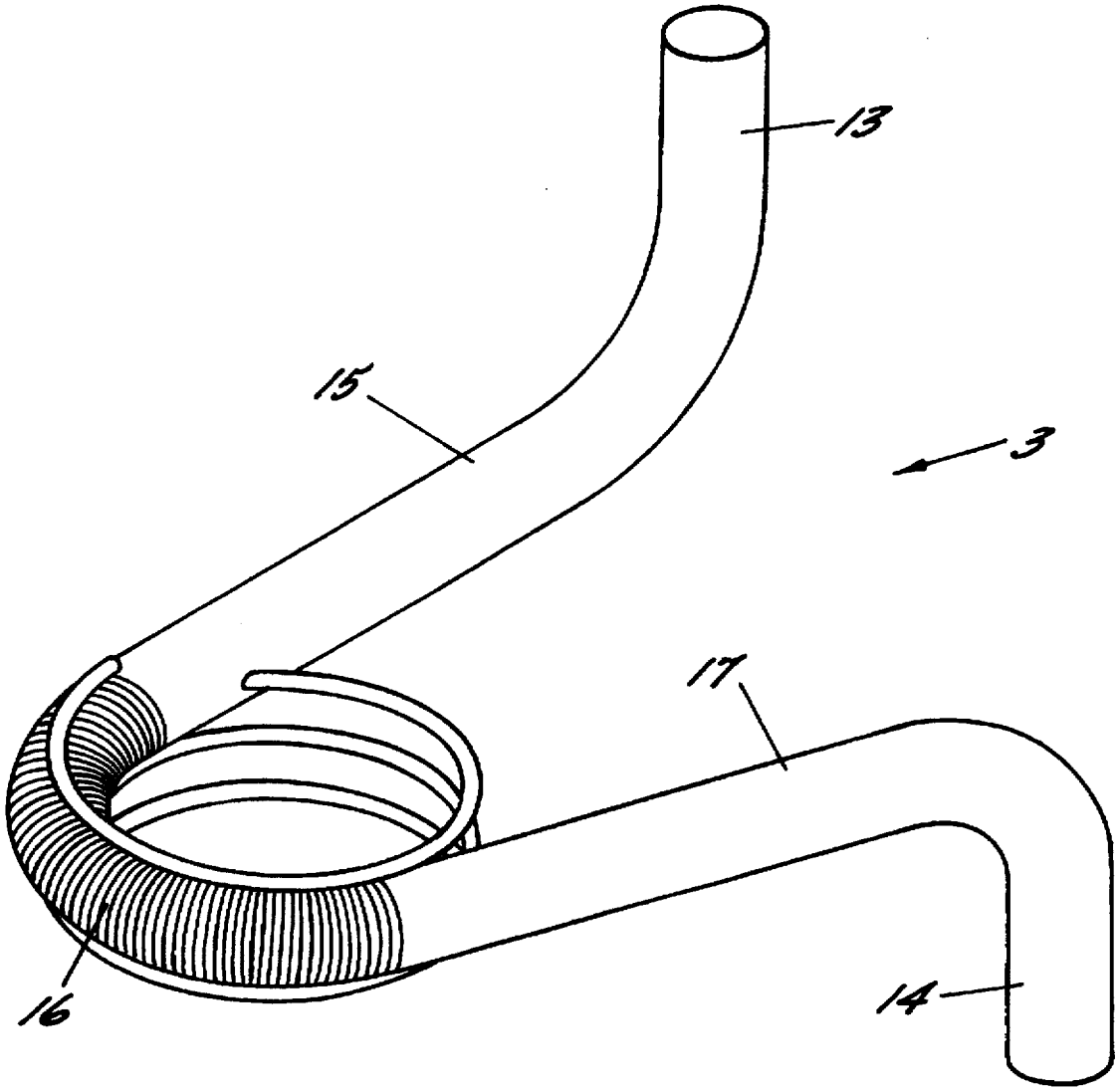
FIG. 3 is a perspective view of a melt line of the spin beam.

As seen in FIG. 3, each line 3 is formed from a monolithic tube which has a uniform internal cross sectional area along its length. Also, each line 3 includes an upper starting segment 13 and a lower end segment 14. The starting segment 13 is followed by a first straight lead-in line segment 15 tangentially adjacent to an elbow 16. The elbow 16 merges into a second straight outlet line segment 17. The second line segment 17 is followed by the lower end segment 14. The starting segment 13 is joined to an opening in the pump connection plate 4, and the end segment 14 is joined to the connection plate 9. The lead-in and outlet line segments 15, 17 are downwardly inclined relative a common horizontal plane when mounted in its operative position in the spin beam. The angle of inclination is preferably about 3°.

As can be seen from FIG. 3, the elbow 16 is helically bent from the monolithic tube which forms the line 3. More particularly, the line 3 is fabricated by first placing the line tangentially onto a bending tool such as a cylinder, clamping the line onto the bending tool by means of a clamping jaw, and then bending the line along the surface of the bending tool and about a predetermined helix angle. Thereafter, the bent line is removed from the bending tool.

As a result of its configuration in accordance with the invention, the melt line exhibits a unidirected gradient along its entire length, and a spin beam equipped therewith has nonetheless a small volume. Since spin beams of this type are heated by a heating medium, they are insulated likewise toward the outside. Also, since their overall volume remains small, heat losses and space requirements are likewise small.

In the drawings and specification, there has been set forth a preferred embodiment of the invention, and although specific terms are employed, they are used in a generic and descriptive sense only and not for purposes of limitation.

That which is claimed is:

1. A melt line for advancing a molten plastic in a spin beam which includes a delivery member and an outlet member positioned below the delivery member, and comprising;

an upper line segment which is downwardly inclined, a lower line segment which is downwardly inclined, and an elbow interconnecting the upper and lower line segments, with the elbow being substantially helical so as to be downwardly inclined along the entire length of the elbow, and With the upper and lower line segments extending in different directions which are each substantially tangent to the helix of the elbow.

2. The melt line as defined in claim 1 wherein said upper line segment and said lower line segment have substantially the same angle of inclination.

3. The melt line as defined in claim 1 wherein said upper line segment, said lower line segment, and said elbow all have substantially the same angle of inclination.

4. The melt line as defined in claim 1 wherein said upper line segment, said lower line segment, and said elbow all have substantially the same internal cross sectional area and substantially the same angle of inclination.

5. The melt line as defined in claim 1 wherein said upper line segment and said lower line segment each extend in directions which are tangent to said helix of said elbow.

6. The melt line as defined in claim 1 further comprising an upper end segment connected to said upper line segment, and a lower end segment connected to said lower line segment, and wherein said upper end segment and said lower end segment each extend in a substantially vertical direction.

7. A self supporting melt distributor unit which is adapted to form a component of a melt spin beam, and comprising an elongate lower support member, a plurality of spinnerets mounted to said lower support member along at least one row, a pump collection plate mounted above said spinnerets and having a plurality of holes extending therethrough, and a plurality of melt distribution lines interconnecting the holes in said pump collection plate with respective ones of said spinnerets, with at least one of said melt distribution lines comprising (a) an upper line segment which is downwardly inclined, (b) a lower line segment which is downwardly inclined, and (c) an elbow interconnecting the upper and lower line segments, with the elbow being substantially helical so as to be downwardly inclined along the entire length of the elbow, and with the upper and lower line segment extending in different directions which are each substantially tangent to the helix of the elbow.

8. The melt distributor unit as defined in claim 7 wherein said melt distribution lines all have substantially the same length.

9. The melt distributor unit as defined in claim 7 wherein said upper line segment, said lower line segment, and said elbow of said one melt distribution line all have substantially the same angle of inclination.

10. The melt distributor unit as defined in claim 9 wherein said upper line segment and said lower line segment of said one melt distribution line each extend in a direction which is tangent to said helix of said elbow.

11. The melt distributor unit as defined in claim 10 wherein said one melt distribution line further comprises an upper end segment connected between said pump collection plate and said upper line segment, and a lower end segment connected between said lower line segment and the associated one of said spinnerets, and wherein said upper end segment and said lower end segment each extend in a substantially vertical direction.

12. The melt distributor unit as defined in claim 11 wherein said one melt distribution line comprises a monolithic tube.

* * * * *